US008092243B1

(12) United States Patent
Journeaux et al.

(10) Patent No.: US 8,092,243 B1
(45) Date of Patent: Jan. 10, 2012

(54) UNIVERSAL SERIAL BUS (USB) CONNECTOR RETAINING DEVICE AND ARRANGEMENT

(75) Inventors: Tom Journeaux, Dalgety Bay (GB); Alexander Brown, Dalgety Bay (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 12/871,958

(22) Filed: Aug. 31, 2010

(51) Int. Cl.
*H01R 4/50* (2006.01)
*H01R 13/625* (2006.01)

(52) U.S. Cl. ..... 439/345; 439/133; 439/304

(58) Field of Classification Search ..... 439/358, 439/133, 304, 147, 923, 345
See application file for complete search history.

(56) References Cited

U.S. PATENT DOCUMENTS 5,603,623 A * 2/1997 Nishikawa et al. ..... 439/144
7,465,181 B1 * 12/2008 Bridges et al. ..... 439/358

* cited by examiner

*Primary Examiner* — Hae Moon Hyeon
(74) *Attorney, Agent, or Firm* — Michael Chan

(57) ABSTRACT

A device for retaining a USB connector in a USB port applies a force either to the walls of the USB port such that the walls of the USB port frictionally engage with the USB connector to retain it in position, or to a finger in a top surface of the USB port such that the finger is biased into an opening of in the USB connector to operate as a catch to prevent the unwanted removal of the USB connector from the USB port.

14 Claims, 2 Drawing Sheets

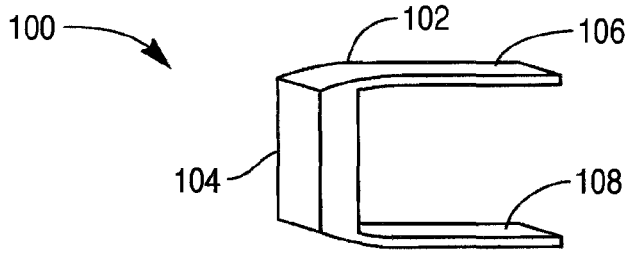
FIG. 1
FIG. 2
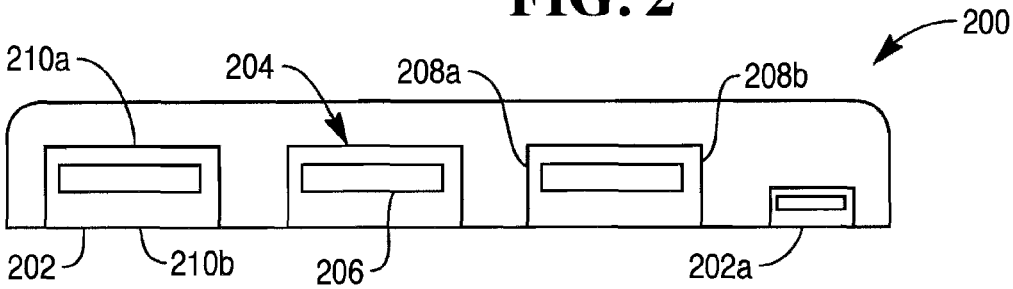
FIG. 2a
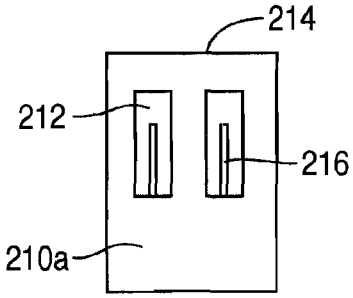
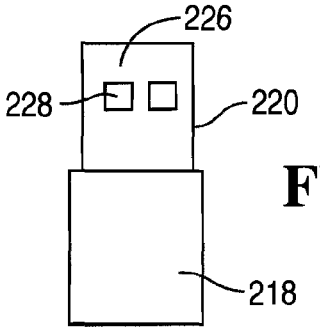
FIG. 2b
FIG. 3
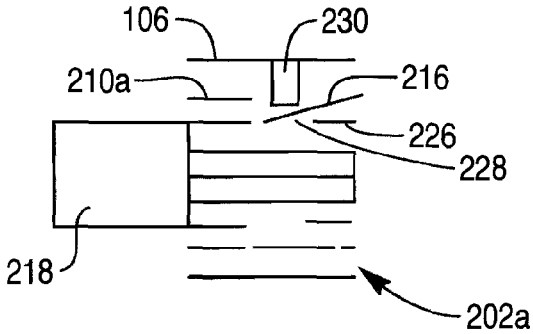

UNIVERSAL SERIAL BUS (USB) CONNECTOR RETAINING DEVICE AND ARRANGEMENT

FIELD OF THE INVENTION

The present invention relates to a universal serial bus connector retaining device and arrangement.

BACKGROUND TO THE INVENTION

The unintentional disconnection of a universal serial bus (USB) connector-port pair can lead to the loss of connection between a central processor and a peripheral device, for example a personal computer (PC) and a printer or wireless modem, or in the case of a self-service terminal (SST) between the PC core of the SST and a card reader or media dispenser. Clearly, the unintentional loss of such a connection is undesirable as it leads to a user being unable to complete a desired action, for example being unable to complete a withdrawal of funds from an automated teller machine (ATM).

The problem of unintentional disconnection of USB connector-port pair is particularly important where the USB port lies internally of, for example, an ATM and cannot be readily accessed to reconnect the USB connector-port pair. Such a mode of failure is known to occur when ATMs are shipped with USB connectors located in a USB hub for connection to the PC core prior to their shipping. This leads to an ATM being received by an operator with a peripheral device, for example, a card reader or a media dispenser being non-functioning and appearing to the customer to be broken. These apparent false peripheral device failures lead to an increased volume of time consuming and expensive diagnostic testing to determine the cause of the apparent peripheral device failure. The downtime of an operator's new ATM leads to loss in transactions, which in turn leads to dissatisfaction amongst the operator's customers and ultimately dissatisfaction with the ATM vendor by the operator.

Attempts at ameliorating this problem have been made including providing a device into which the USB cables are tied, or held by retaining structures formed in the device at a point close to the USB. These devices are bulky, occupying a significant volume of space in the body of a self-service terminal where such space is at a premium. Additionally, as the cables are retained close to the USB connector, but not immediately adjacent it, movement of the cable between its point of retention and the USB connector is still possible which can result in the disconnection of the USB connector during either manufacture or shipping of the self-service terminal.

SUMMARY OF THE INVENTION

According to a first aspect of the present invention there is provided a universal serial bus connector retaining device comprising:

a frame arranged to bias at least a portion of at least one wall of a USB port housing such that said at least portion of said at least one wall is urged towards, and frictionally engages an outer surface of a USB connector when inserted into said housing.

The frictional engagement between the USB connector and the wall of the USB port housing which has been biased towards the USB connector by the framework militates against the unintentional disconnection of the USB connector from the USB port as the frictional force resists the disconnection of the USB connector from the USB port.

The frame may comprise a U-shaped channel section. The U-shaped channel section may be arranged to extend over the length of the USB port housing. The U-shaped channel section may have a distance between respective inner surfaces of its opposing arms which is the same width as the USB port housing. The U-shaped channel section may have a distance between respective inner surfaces of its opposing arms which is slightly less than the width of the USB housing. The U-shaped channel section may have distance between the inner surfaces of its opposing arms which decreases towards respective free ends of the arms. The U-shaped channel section may be formed of a resilient material, such as a plastics material. The U-shaped channel section may be formed of a metal material.

The frame may comprise a plurality of U-shaped channel sections each of which is arranged to bias at least one wall of a respective USB port housing, for example, of a USB hub.

The frame may comprise one or more U-shaped channel sections dimensioned to fit around a USB port housing of a first size and one or more U-shaped channel sections dimensioned to fit around a USB port housing of a second size, for example a standard USB port housing and a mini-USB port housing.

All three sides of the U-shaped channel section may be arranged to bias a respective wall of the USB port housing towards a common point. The U-shaped channel section may be arranged to compress the USB port housing.

The frame may comprise at least one projection arranged to engage with a tine of the USB port housing, such that the tine is urged to positively engage with an opening in the USB connector.

The frame may comprise a front piece and a biasing member, the front piece being arranged to locate between the USB port housing and a body portion of the USB connector, the body portion of the USB connector remaining outside of the USB port housing at all times, the plate has an opening therethrough to allow a head portion of the USB connector to mate with the USB port, the biasing member being arranged to bias the at least one wall. The biasing member may comprise an arm section which extends perpendicularly with respect to the front piece over the USB port housing. The biasing member may comprise at least one finger which depends from the arm and is arranged to engage with a tine of the USB port housing, such that the tine is urged to positively engage with an opening in the USB connector.

The frame may comprise a plurality of openings, each of which is associated a respective at least one finger. Typically, each opening may be associated with two respective fingers.

According to a second aspect of the present invention there is provided a method of retaining a USB connector in a USB port comprising the steps of:

applying a force to at least one wall of a housing of the USB port by a retaining device; and urging the at least one wall of the housing into frictional engagement with the USB connector in response to the application of said force.

BRIEF DESCRIPTION OF THE DRAWINGS

The invention will now be described, by way of example only, with reference to the accompanying drawings, in which:

FIG. 1 is a perspective view of a first embodiment of a USB connector retaining device according to an aspect of the present invention;

FIG. 2 is a front elevation of a USB hub and a USB connector retaining device comprising a plurality of the devices of FIG. 1;

FIG. 2*a* is a plan view of a USB housing of the USB hub of FIG. 2;

FIG. 2*b* is a plan view of a USB connector for insertion into the housing of FIG. 2*a;*

FIG. 3 is a cross-section through a mini-USB connector of the hub of FIG. 2 comprising wherein the retaining device comprises a spigot;

DETAILED DESCRIPTION OF THE PREFERRED EMBODIMENTS

Figure 4:
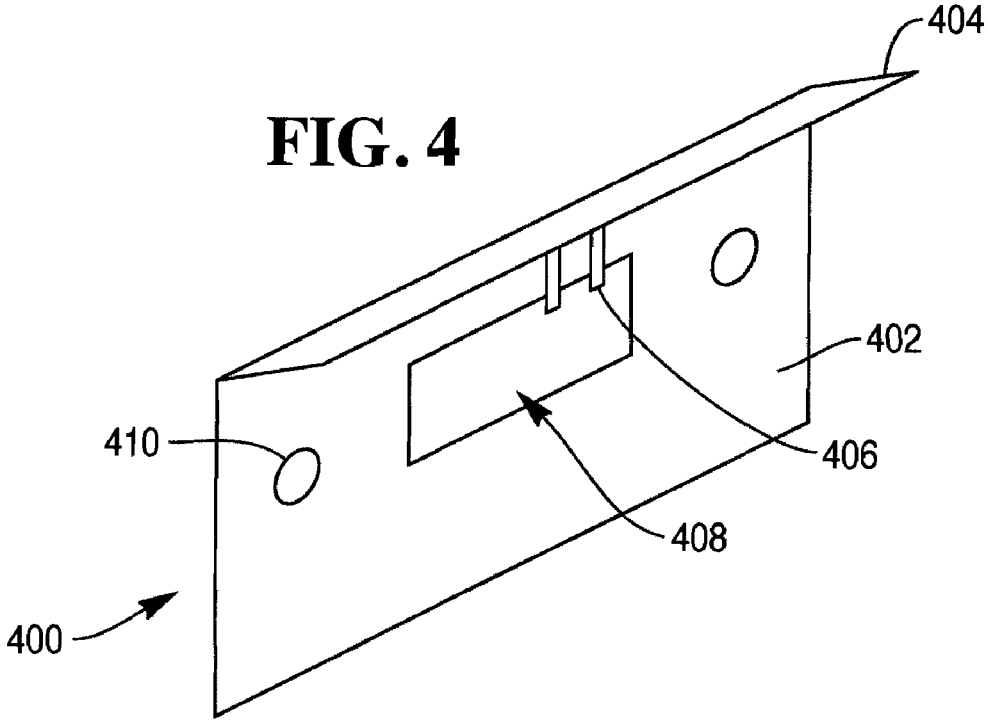
FIG. 4 is a perspective view of a second embodiment of a USB connector retaining device according to an aspect of the present invention.

Referring now to FIGS. 1, 2, 2*a*, 2*b* and 3, a USB connector retaining device 100 comprises a substantially U-shaped channel section 102 made of a resilient material such as a plastics material or formed from a sheet of metal. The channel section 102 comprises a base 104 and a pair of opposing arms 106, 108. The ratio of the length of the base 104 to the length of the arms 106, 108 is approximately 1:3. The distance between the opposing arms 106, 108 may be slightly less at their free ends than at the base 104, or they may remain substantially parallel over their length.

Referring now to FIGS. 2, 2*a* and 2*b* in particular, a USB hub 200 comprises a number of USB ports 202 including a mini-USB port 202*a*, each port comprises a housing 204 and contact pad 206 which lies internally of the housing 204. The housing 204 comprises a rectangular box-section, typically formed from sheet metal, in which opposing side walls 208*a,b* are approximately one third the length of opposing upper and lower walls 210*a,b*. Typically, the upper and lower walls 210*a,b* have a pair of U-shaped cutaways 212 formed therein adjacent a front edge 214 of the housing 204 such that respective pairs of tines 216 are formed. Typically, the tines 216 are flexible in a direction perpendicular to the plane of the upper and lower walls 210*a,b*.

A USB connector 218 comprises a housing 220 and contact pad which lies internally of the housing 220. The housing 220 comprises a rectangular box-section, typically formed from sheet metal, in which opposing side walls are approximately one third the length of opposing upper and lower walls 226 and has external dimensions slightly smaller than the external dimensions of the housing 204 of USB port 202. Typically, the upper and lower walls 226 have respective pairs of openings 228 therethrough towards the rear of the housing 220.

Each USB port 202 has a retaining device 100 placed around it such that the opposing side walls 208*a,b* of the housing 204 are compressed inwardly by the arms 106, 108. In the present embodiment the retaining devices 100 are provided as a single piece, although it will be appreciated that they can be cast and fitted individually. As the connector 220 is inserted into the port 202 the side walls 208*a,b* of the housing 204 frictionally engage and grip the USB connector housing 220 due to the inward compression of the side walls 208*a,b* of the USB port housing 204. This frictional engagement increases the hold exerted on the connector 218 by the housing 204.

Referring now to FIG. 3 in particular, in the case of the mini-USB port 202*a* the retaining device 100 comprises a pair of spigots 230 formed on its upper arm 106, which exert a force on the tines 216 in the upper wall 210*a* of the housing 204 such that they deflect inwardly into the body of the housing 204. Upon insertion of a mini-USB connector 218 into the mini-USB port 202*a* the tines 216 positively locate in the openings 228 in the upper wall 226 of the mini-USB connector 218. The positive location of the tines 216 in the openings 228 retains the mini-USB connector 218 in position in the mini-USB port 202*a*.

It will be further appreciated that although described with the mini-USB retaining device having projecting spigots 230, any USB retaining device of the present embodiment can include such features.

It will be still further appreciated that although described with reference to spigots 230 being formed on only the upper arm 106 of the retaining device 100 such spigots may be formed on either, or both, the upper arm 106 and the lower arm 108 of the retaining device as required.

It will be yet further appreciated that a single spigot 230 may be formed on either, or both, of the upper arm 106 and the lower arm 108 of the retaining device 100 as is appropriate.

Figure 5:
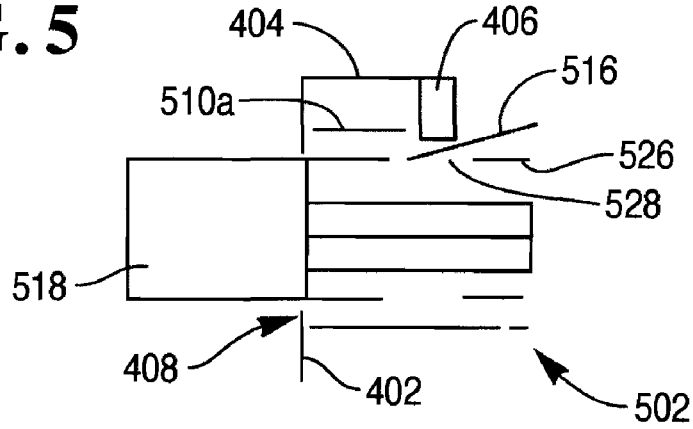
FIG. 5 is a cross-section through the device of FIG. 4, a USB port and a USB connector, in use.

Referring now to FIGS. 4 and 5, references to a USB connector, USB port and USB housing will be made, these parts are identical to those referenced in relation to FIGS. 2, 2*a* and 2*b* and will be accorded similar reference numerals in the five hundred series where necessary.

A USB connector retaining device 400 comprises a front plate 402, an arm 404 and fingers 406.

The front plate 402 has a rectangular opening 408 therethrough dimensioned to allow a USB connector 518 to pass therethrough. The front plate 402 also has two circular openings 410 therethrough dimensioned to allow fastening screws to pass therethrough such that the retaining device 400 can be fastened to a mounting block or other support structure in which a USB port 502 is mounted.

The arm 404 projects from a top edge of the front plate 402 in a direction perpendicular to the plane of the front plate 402. Typically, the arm 402 has a length which is approximately equal to distance between the front of the USB port 502 and the mid-point of the tines 516.

The fingers 406 depend from the end of the arm 404 which is remote from the front plate 402. The fingers 406 oppose the front plate 402 and are parallel thereto. The spacing between the fingers 406 corresponds to the spacing between the mid-points of the tines 516.

In use, the retaining device 400 is fixed to mounting block by screws passing through the circular openings 410 into the block. The rectangular opening 408 is aligned with the opening of the USB port 502. The arm 404 extends over the top wall 510*a* of the USB port 502 such that the fingers 406 depress the tines 516 such that when the USB connector 518 is inserted into the USB port 502 the tines 516 positively engage the in the openings 528 in the USB connector's upper wall 526. The positive location of the tines 516 in the openings 528 retains the USB connector 518 in position in the USB port 502.

It will be appreciated that a plurality of retaining devices can be formed in a single piece of material such that it can be used to retain a number of USB connectors 518 in a USB hub.

It will be appreciated that the terms "usually", "typically", etc., as used herein are used in a non-exclusive sense, in so far as alternative or additional features to those described as usual or typical are envisaged.

It will be appreciated that the present invention may be used in any one of the following electronic devices: a mobile telephone, a personal computer, a personal digital assistant, an automated teller machine (ATM), a vending kiosk, a retail self check-out terminal, a postal stamping machine, a travel self-check in terminal, a hospitality self check-in/check-out terminal, or any device in which It will also be appreciated that the steps of the methods described herein may be carried out in any suitable order, or simultaneously where appropriate.

Various modifications may be made to the above described embodiments without departing from the spirit and the scope of the invention.

The invention claimed is:

1. A universal serial bus (USB) connector retaining device comprising:

a frame arranged to bias at least a portion of at least one wall of a USB port housing such that at least the portion of the at least one wall is urged towards, and frictionally engages an outer surface of a USB connector when inserted into the USB port housing, wherein (i) the frame comprises a U-shaped channel section, and (ii) opposing arms of the U-shaped channel section have a distance between their respective inner surfaces which is slightly less than the width of the USB housing.

2. The device of claim 1 wherein, the U-shaped channel section is arranged to extend over the length of the USB port housing.

3. The device of claim 1 wherein, the U-shaped channel section is formed of a resilient material.

4. The device of claim 1 wherein, the frame comprises a plurality of U-shaped channel sections each of which is arranged to bias at least one wall of a respective USB port housing.

5. The device of claim 1 wherein, the frame comprises one or more U-shaped channel sections dimensioned to fit around a USB port housing of a first size and one or more U-shaped channel sections dimensioned to fit around a USB port housing of a second size.

6. The device of claim 1 wherein, the U-shaped channel section is arranged to compress the USB port housing.

7. The device of claim 1 wherein, the frame comprises at least one projection arranged to engage with a tine of the USB port housing, such that the tine is urged to positively engage with an opening in the USB connector.

8. The device of claim 1 wherein, the frame comprises a front piece and a biasing member, the front piece being arranged to locate between the USB port housing and a body portion of the USB connector, the body portion of the USB connector remaining outside of the USB port housing at all times, the plate has an opening therethrough to allow a head portion of the USB connector to mate with the USB port, the biasing member being arranged to bias the at least one wall.

9. The device of claim 8 wherein, the biasing member comprises an arm section which extends perpendicularly with respect to the front piece over the USB port housing.

10. The device of claim 9 wherein, the biasing member comprises at least one finger which depends from the arm and is arranged to engage with a tine of the USB port housing, such that the tine is urged to positively engage with an opening in the USB connector.

11. The device of claim 10 wherein, each opening may be is associated with two respective fingers.

12. The device of claim 8 wherein, the frame comprises a plurality of openings, each of which is associated a respective at least one finger.

13. A universal serial bus (USB) connector retaining device comprising:

a frame arranged to bias at least a portion of at least one wall of a USB port housing such that at least the portion of the at least one wall is urged towards, and frictionally engages an outer surface of a USB connector when inserted into the USB port housing, wherein (i) the frame comprises a U-shaped channel section, and (ii) opposing arms of the U-shaped channel section have distance between their respective inner surfaces which decreases towards respective free ends of the arms.

14. A universal serial bus (USB) connector retaining device comprising:

a frame arranged to bias at least a portion of at least one wall of a USB port housing such that at least the portion of the at least one wall is urged towards, and frictionally engages an outer surface of a USB connector when inserted into the USB port housing, wherein (i) the frame comprises a U-shaped channel section, and (ii) all three sides of the U-shaped channel section are arranged to bias a respective wall of the USB port housing towards a common point.

* * * * *